US008064792B2

(12) United States Patent
Okamoto et al.

(10) Patent No.: US 8,064,792 B2
(45) Date of Patent: Nov. 22, 2011

(54) IMAGE FORMING APPARATUS WITH AN INDEPENDENT DRIVE UNIT FOR A CLEANING UNIT

(75) Inventors: Tsugio Okamoto, Kani (JP); Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/732,418

(22) Filed: Mar. 26, 2010

(65) Prior Publication Data

US 2010/0183328 A1 Jul. 22, 2010

Related U.S. Application Data

(62) Division of application No. 11/476,896, filed on Jun. 29, 2006, now Pat. No. 7,720,407.

(30) Foreign Application Priority Data

Jun. 29, 2005 (JP) ..... 2005-189545

(51) Int. Cl.
*G03G 15/16* (2006.01)

(52) U.S. Cl. ..... 399/101; 399/308

(58) Field of Classification Search ..... 399/101, 399/299, 303, 302, 308, 345
See application file for complete search history.

(56) References Cited

U.S. PATENT DOCUMENTS

| | | | |
|---|---|---|---|
| 3,985,436 | A * | 10/1976 | Tanaka et al. |
| 5,887,217 | A * | 3/1999 | Mitekura et al. |
| 6,185,396 | B1 | 2/2001 | Aizawa et al. |
| 6,249,663 | B1 | 6/2001 | Aizawa et al. |
| 6,366,756 | B1 | 4/2002 | Aizawa et al. |
| 6,418,296 | B1 | 7/2002 | Aizawa et al. |
| 6,608,991 | B2 | 8/2003 | Takada |
| 2003/0156864 | A1 | 8/2003 | Tachiki et al. |
| 2005/0135852 | A1 * | 6/2005 | Sekiguchi |

FOREIGN PATENT DOCUMENTS

| | | | |
|---|---|---|---|
| JP | 58-087069 | | 5/1983 |
| JP | 06051576 | A * | 2/1994 |
| JP | 08-095339 | | 4/1996 |
| JP | 09-152788 | | 6/1997 |
| JP | 09-197761 | | 7/1997 |
| JP | 10-133450 | | 5/1998 |
| JP | 11-024350 | | 1/1999 |
| JP | 11-065199 | | 3/1999 |
| JP | 11-352801 | | 12/1999 |
| JP | 2000-194243 | | 7/2000 |
| JP | 2001-166554 | | 6/2001 |
| JP | 2001-312149 | | 11/2001 |
| JP | 2008076621 | A * | 4/2008 |

* cited by examiner

*Primary Examiner* — David Gray
*Assistant Examiner* — Laura K Roth
(74) *Attorney, Agent, or Firm* — Banner & Witcoff, Ltd

(57) ABSTRACT

An image forming apparatus may include an intermediate transfer belt for transferring, onto a sheet, a developer image that has been transferred from an image carrier to the intermediate transfer belt. The image forming apparatus may also include a cleaning unit that cleans the sheet conveying belt. The image forming apparatus that may also include a first driving unit that drives the intermediate transfer belt; a second driving unit that drives the cleaning unit, wherein the second driving unit is independent from the first driving unit; and a sheet conveying mechanism that conveys the sheet, wherein the second driving unit drives at least a part of the sheet conveying mechanism.

18 Claims, 4 Drawing Sheets

IMAGE FORMING APPARATUS WITH AN INDEPENDENT DRIVE UNIT FOR A CLEANING UNIT

CROSS REFERENCE TO RELATED APPLICATION

This application is a divisional application of co-pending U.S. patent application Ser. No. 11/476,896, filed on Jun. 29, 2006, the entire subject matter of which is incorporated herein by reference, which claims priority from Japanese Patent Application No. 2005-189545, filed on Jun. 29, 2005, the entire subject matter of which is incorporated herein by reference.

TECHNICAL FIELD

Aspects of the present invention relate to an image forming apparatus including a laser printer and more particularly to an image forming apparatus provided with a cleaning unit for cleaning a belt.

BACKGROUND

Conventionally, an image forming apparatus including a laser printer, which has such a structure that an endless belt is employed for conveying sheets of paper and for conducting intermediate transfer, has been known. In the image forming apparatus having this structure, there is generally provided a cleaning unit including a roller and/or a brush, in order to remove foreign substances such as toner, paper dust, etc., which have adhered to a surface of the belt. In an image forming apparatus disclosed in JP-A-9-152788, for example, a cleaning roller that is in pressure contact with the surface of the belt is driven to rotate so that foreign substances, which have been shifted from the belt to the cleaning roller, is scraped off by a blade. The cleaning unit of this type is usually driven, making use of power of a motor for driving the belt.

SUMMARY

By the way, with an enhanced request for images of high quality in recent years, uses of polymerized toner as developer has been more and more increased. Because the polymerized toner has excellent fluidity due to its nearly spherical shape and uniform particle diameter, it is possible to obtain enhanced quality of the images. However, there has been a problem that the polymerized toner is unlikely to be removed when it has adhered to the surface of the belt or the like. Under the circumstances, it has been desired that cleaning performance of the cleaning unit to be enhanced.

In order to enhance the cleaning performance of the cleaning unit, it would be advantageous to increase contact pressure of the cleaning roller to be exerted on the belt, or to increase contact pressure of the blade to be exerted on the cleaning roller. However, in case where the contact pressures have been increased, a larger load will be required for driving the cleaning unit, which will adversely affect operation of the belt, and irregularity in speed of the belt will be likely to occur. Consequently, there is such a possibility that the quality of the images may be deteriorated. In order to solve such problem, it has been considered that the cleaning unit is driven by employing an exclusive motor separately from the motor for driving the belt. In this case, however, additional components are required, and so, upsizing of the apparatus, an increase of electric power consumption, and increase in cost will be incurred.

Aspects of the invention provide an image forming apparatus with which high quality of images can be ensured, while achieving the downsizing, cost reduction of the apparatus, and decrease of electric power consumption.

DETAILED DESCRIPTION

First Aspect

Now, a first aspect of the invention will be described referring to FIGS. 1 and 2.

(Overall Structure of a Laser Printer)

Figure 1:
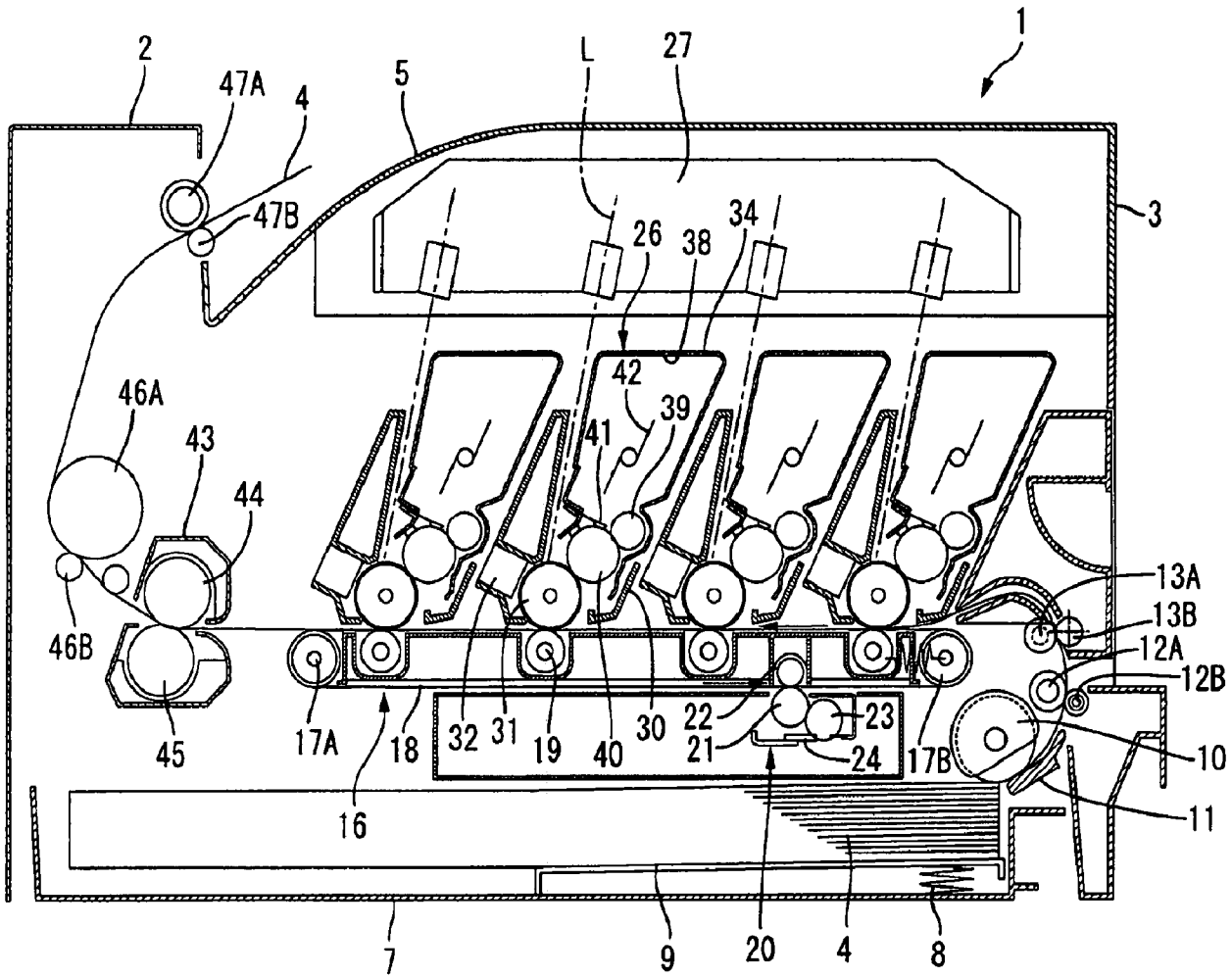
FIG. 1 is a sectional view schematically showing a structure of a laser printer according to a first aspect of the invention.

FIG. 1 is a sectional side view schematically showing a structure of a laser printer 1 as an image forming apparatus according to this aspect. It is to be noted that a right side in FIG. 1 is regarded as a front side, in the following description.

This laser printer 1 is a color laser printer of a tandem type for direct transfer. The laser printer 1 includes a main body casing 2 in a substantially box-like shape, as shown in FIG. 1. A top face cover 3, which can be opened or closed, is provided on an upper face of the main body casing 2. By opening the top face cover 3, it will be possible to exchange a process cartridge 26 and a belt unit 16 in the main body casing 2. There is further formed, on a surface of the top face cover 3, a paper discharging tray 5 on which sheets 4 will be stacked after an image forming process has been finished.

In a lower part of the main body casing 2, a paper feeding tray 7 that accommodates a sheet 4 on which an image is formed is mounted. The paper feeding tray 7 can be withdrawn frontward. The paper feeding tray 7 is provided therein with a paper pressing plate 9 that is urged by a spring 8 so as to be tilted in a manner of lifting a leading end side of the sheet 4. At a position above a leading end of the paper feeding tray 7, there are provided a pickup roller 10, which functions as an intermittent motion mechanism and a driven mechanism, and a separating pad 11, which is urged by a spring (not shown) so as to be in pressure contact with the pickup roller 10. The pickup roller 10 is in a substantially D-shape in section and has on its outer peripheral part a circumferential face which will come into contact with a surface of the sheet 4 and a non-contact position which will not come into contact with the sheet 4. The pickup roller 10 will be intermittently driven to rotate. The uppermost sheet 4 on the paper feeding tray 7 will be pressed by the paper pressing plate 9 toward the pickup roller 10, and will be separated one by one, when the sheet 4 is clamped between the pickup roller 10 and the separating pad 11, with the rotation of the pickup roller 10.

At a diagonally forward and upward position of the pickup roller 10, there are provided a paper feeding roller 12A (the driven mechanism), which is driven to rotate, and a further paper feeding roller 12B that is faced with the paper feeding roller 12A and rotated following the rotation of the paper feeding roller 12A. At a further upward position, there are provided a registration roller 13A (the intermittent motion mechanism and the driven mechanism), which is intermittently driven to rotate, and a further registration roller 13B that is faced with the registration roller 13A and rotated following the rotation of the registration roller 13A. The sheet 4, which has been fed from between the pickup roller 10 and the separating pad 11, will be conveyed to the registration rollers 13A, 13B, with the rotations of the paper feeding rollers 12A, 12B. The registration rollers 13A, 13B will convey the sheet 4 to the belt unit 16 in the downstream, at a predetermined timing, after the skew of the sheet 4 has been corrected.

The belt unit 16 is detachably mounted in the main body casing 2. The belt unit 16 includes a belt supporting roller 17A which is located rearward and driven to rotate; a further belt supporting roller 17B which is located forward and rotated following the rotation of the belt supporting roller 17A; and a conveying belt 18 which is stretched between the two belt supporting rollers 17A and 17B. The conveying belt 18 is an endless belt formed of resin material such as polycarbonate. When the rearward belt supporting roller 17A is driven to rotate, the conveying belt 18 will cyclically move in a counterclockwise direction in FIG. 1, thereby to convey the sheet 4, which is carried on its upper face, rearward. Inside the conveying belt 18, four transfer rollers 19 that are respectively opposed to photosensitive drums 31 of the process cartridges 26, which will be described below, are arranged at predetermined intervals in a longitudinal direction, in such a manner that the conveying belt 18 is interposed between the photosensitive drums 31 and the corresponding transfer rollers 19. The transfer rollers 19 can make follow-up rotations, and transfer biases will be applied between the transfer rollers 19 and the corresponding photosensitive drums 31, when transfer process is performed.

Underneath the belt unit 16, there is provided a cleaning device 20 (a cleaning unit) for removing toner, paper dust, etc., which have adhered to the transfer belt 18. The cleaning device 20 includes a cleaning roller 21 having foam material of silicone or urethane provided around a shaft member, which is made of metal and extends in a lateral direction of the transfer belt 18. This cleaning roller 21 is opposed to a backup roller (a grounding roller) 22 which is made of metal and provided in the belt unit 16 so as to make follow-up rotation, interposing the conveying belt 18. The cleaning roller 21 will be driven to rotate in an opposite direction to the direction of the conveying belt 18, while it is in contact with a lower face (an outer face) of the conveying belt 18, and at the same time, a predetermined bias (removing bias) will be applied between the cleaning roller 21 and the backup roller 22, whereby the toner or the like on the conveying belt 18 will be electrically removed by the cleaning roller 21. Moreover, a recovering roller 23 made of metal is provided in contact with the cleaning roller 21. This recovering roller 23 will be driven to rotate at a different circumferential speed from the cleaning roller 21, while subjected to the stronger removing bias than to the cleaning roller 21, whereby the toner or the like which has adhered to a surface of the cleaning roller 21 will be removed. Further, a blade 24 for scraping off the toner or the like adhered to a surface of the recovering roller 23 is provided in contact with the recovering roller 23.

The four process cartridges 26 corresponding to four colors, namely, magenta, yellow, cyan, and black, are detachably mounted above the belt unit 16, in parallel in the longitudinal direction. Further above the process cartridges 26, there is provided a scanner device 27, which is integrally fitted to the top face cover 3. The scanner device 27 irradiates, by rapid scanning, laser beams L corresponding to the respective colors based on predetermined image data, onto the surfaces of the corresponding photosensitive drums 31.

Each of the process cartridges 26 includes a cartridge frame 30 in a frame-like shape; the photosensitive drum 31; and a scorotron type charger 32 which are provided in a lower part of the cartridge frame 30, and a developing cartridge 34 which is detachably fitted to the cartridge frame 30.

Each of the photosensitive drums 31, which functions as an image carrier, includes a grounded drum body made of metal; and a photosensitive layer formed of polycarbonate or the like, which can be positively charged, is covered over the drum body. The photosensitive drum 31 will be driven to rotate in a clockwise direction in the drawing.

The scorotron type charger 32 is arranged above the photosensitive drum 31 at a diagonally rearward position in a manner opposed to the photosensitive drum 31, keeping a predetermined distance so as not to come into contact with the photosensitive drum 31. This scorotron type charger 32 will generate corona discharge from an charging wire of tungsten or the like, thereby to positively charge the surface of the photosensitive drum 31 uniformly.

Each of the developing cartridges 34 is in a substantially box-like shape and includes a toner containing room 38 in an upper part thereof. A supply roller 39, a developing roller 40, and a layer thickness regulating blade 41 are provided in a lower part thereof. As the developers, non-magnetic toners of mono-component type for positive charging of the respective colors, namely, yellow, magenta, cyan and black are contained in the respective toner containing rooms 38. As the toners, polymerized toner which is obtained by copolymerizing polymeric monomer, for example, styrene monomer such as styrene, acryl monomer such as acrylic acid, alkyl (C1-C4) acrylate, alkyl (C1-C4) methacrylate, by known polymerization method such as suspension polymerization is employed. The polymerized toner of this type is in a substantially globular shape having an average particle diameter of about 6 to 10 μm, and has excellent fluidity, whereby formation of an image of high quality can be achieved. Moreover, the toner is blended with coloring agent such as carbon black, wax and so on, and added with outer admixture such as silica, for enhancing the fluidity. Further, the toner containing rooms 38 are respectively provided with agitators 42 which are driven to rotate thereby to agitate the toners.

The supply roller 39 is constructed by covering a roller shaft made of metal with electrically conductive foam material, and will be driven to rotate in a counterclockwise direction in the drawing. The developing roller 40 is constructed by covering a roller shaft made of metal with electrically conductive rubber material, and will be driven to rotate in a counterclockwise direction in the drawing. The toner discharged from the toner containing room 38 will be supplied to the developing roller 40 with the rotation of the supply roller 39, and positively charged by friction between the supply roller 39 and the developing roller 40. The toner supplied to a surface of the developing roller 40 will intrude between the layer thickness regulating blade 41 and the developing roller 40 with the rotation of the developing roller 40. Then, the toner will be further sufficiently charged there by friction, and carried on the developing roller 40 as a thin layer having a certain thickness.

To begin with, the surface of the photosensitive drum 31 will be positively charged uniformly by the scorotron type charger 32, while it rotates, and thereafter, will be exposed to light by rapid scanning of the laser beam from the scanner device 27, whereby an electrostatic latent image corresponding to the image to be formed on the sheet 4 will be formed.

Then, the toner which is carried on the developing roller 40 and positively charged will be supplied to the electrostatic latent image which has been formed on the surface of the photosensitive drum 31, when the toner arrives at a position opposed to the photosensitive drum 31 and comes into contact therewith, with the rotation of the developing roller 40. In this manner, the electrostatic latent image on the photosensitive drum 31 will be converted into a visual image, and a toner image by reverse development will be carried on the surface of the photosensitive drum 31.

Thereafter, the toner images carried on the surfaces of the respective photosensitive drums 31 will be sequentially transferred to the sheet 4 by the transfer biases of negative polarity which are applied to the transfer rollers 19, while the sheet 4 conveyed by the conveying belt 18 passes respective transfer positions between the photosensitive drums 31 and the transfer rollers 19. Then, the sheet 4 to which the toner images have been transferred in this manner will be conveyed to a fixing device 43.

The fixing device 43 is arranged in a rearward area of the conveying belt 18 in the main body casing 2. This fixing device 43 includes a heating roller 44 which is provided with a heat source such as a halogen lamp and driven to rotate; and a pressurizing roller 45 which is arranged below the heating roller 44. The pressurizing roller 45 is opposed to the heating roller 44 so as to pressurize it, and driven to rotate following the rotation of the heating roller 44. In this fixing device 43, the sheet 4 carrying thereon the toner images of the four colors will be heated, while the sheet 4 is clamped between the heating roller 44 and the pressurizing roller 45 and conveyed. In this manner, the toner images will be fixed on the sheet 4.

At a diagonally rearward and upward position of the fixing device 43, there are arranged a conveying roller 46A which is driven to rotate; and a further conveying roller 46B which is rotated following the rotation. Further above the conveying rollers 46A, 46B, there are arranged a paper discharging roller 47A which is driven to rotate; and a further paper discharging roller 47B which is rotated following the rotation. The sheet 4 which has been fixed by heating will be conveyed to the paper discharging rollers 47A, 47B by means of the conveying rollers 46A, 46B, and discharged from the paper discharging rollers 47A, 47B onto the above described paper discharging tray 5. It is to be noted that the sheet conveying mechanism in this aspect means those components for conveying the sheet 4, separately from the conveying belt 18, specifically, the pickup roller 10, the paper feeding rollers 12A, 12B, the registration rollers 13A, 13B, the fixing device 43, the conveying rollers 46A, 46B, and the paper discharging rollers 47A, 47B.

(Driving Mechanism)

Figure 2:
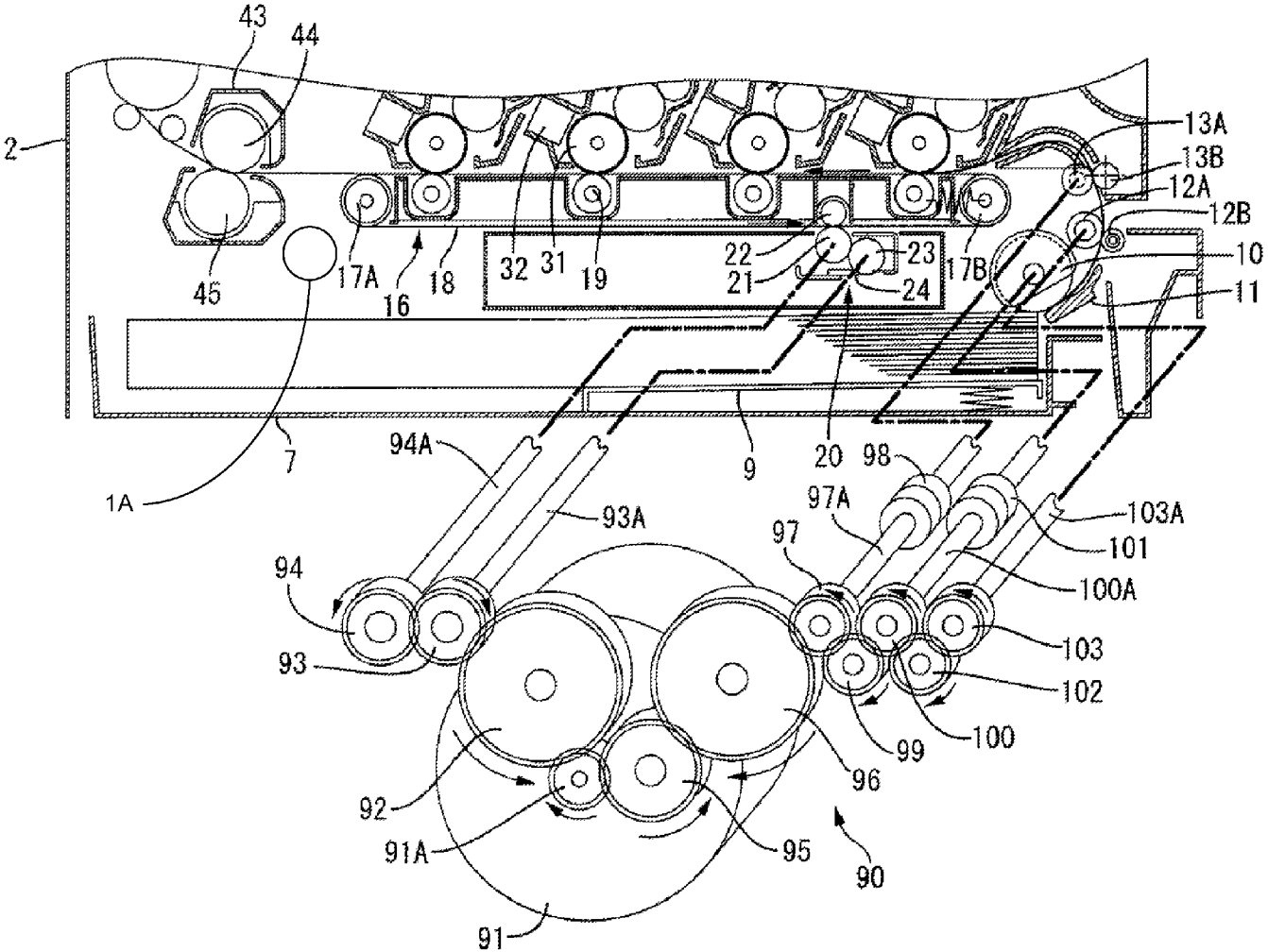
FIG. 2 is an explanatory view schematically showing a driving mechanism.

FIG. 2 is an explanatory view schematically showing a driving mechanism 90, which constitutes a part of a driving system in the laser printer 1. The driving mechanism 90 includes a driving motor 91 (a second driving unit), as a power source. The driving mechanism 90 has a driving gear 91A that is meshed with a relay gear 92. Further, a recovering gear 93 that is connected to the recovering roller 23 via a shaft body 93A, and a cleaning gear 94 that is connected to the cleaning roller 21 via a shaft body 94A are successively meshed with this relay gear 92. The driving gear 91A is also meshed with a pair of relay gears 95, 96, successively. The relay gear 96 is meshed with a registration gear 97 that is connected to the registration roller 13A via a shaft body 97A. On a halfway of the shaft body 97A, there is provided a registration clutch 98 that can switch transmission and interruption of the power. The registration gear 97 is meshed with a relay gear 99, and a pickup gear 100 that is connected to the pickup roller 10 via a shaft body 100A is meshed with this relay gear 99. On a halfway of the shaft body 100A, there is provided a pickup clutch 101 that can switch transmission and interruption of the power. Further, the pickup gear 100 is meshed with a relay gear 102, and a paper feeding gear 103 that is connected to the paper feeding roller 12A via a shaft body 103A is meshed with the relay gear 102.

It is to be noted that other driven components (the belt supporting roller 17A, the photosensitive drum 31, the developing roller 40, the supply roller 39, the agitator 42, and so on) in the laser printer 1 are so constructed as to be driven by a first driving unit 1A (see FIG. 2) which is independent from the driving mechanism 90.

When printing process has started, the driving motor 91 will be driven, and the gears 93, 94, 97, 100, 103 will be respectively driven to rotate in directions of arrow marks in FIG. 2. While the driving motor 91 is driven, the power of the driving motor 91 is always transmitted to the cleaning roller 21, the recovering roller 23, and the paper feeding roller 12A so that these rollers can be always driven to rotate. On the other hand, the pickup roller 10 and the registration roller 13A will be intermittently driven, because the power of the driving motor 91 will be transmitted or interrupted by means of the clutches. Operations of the belt supporting roller 17A and the photosensitive drum 31 by the first driving unit 1A will be also started.

During standby for supply of the sheet, the pickup roller 10 rests in a phase where the non-contact position is opposed to a surface of the sheet 4. The pickup roller 10 will be intermittently driven, according to a paper feeding command, so as to stop when the pickup clutch 101 is turned off, after one rotation of the paper feeding roller 12A. The sheet 4 at the uppermost position on the paper feeding tray 7 will be separated one by one between the pickup roller 10 and the separating pad 11, as described above, and thereafter, will be conveyed to the registration rollers 13A, 13B by means of the paper feeding rollers 12A, 12B. The registration rollers 13A, 13B are initially stopped, by turning off the register clutch 98. When a leading end of the sheet 4 which has been fed from the paper feeding rollers 12A, 12B are butted against a nip part between the registration rollers 13A, 13B in the stopped state, a loop is formed in the sheet 4, whereby the skew of the sheet 4 will be corrected. Then, the registration rollers 13A, 13B will be started to rotate by turning on the register clutch 98, and the sheet 4 will be fed out toward the conveying belt 18.

After the leading end of the sheet 4 has been fed from the registration rollers 13A, 13B, a laser beam will be emitted from the scanner device 27 to the photosensitive drum 31 for a first color, and writing of an image (exposure to light) will be started. When the sheet 4 has arrived at the transfer position between the photosensitive drum 31 and the transfer roller 19, the toner image on the photosensitive drum 31 will be transferred onto the sheet 4. While the toner images having the respective colors are sequentially transferred onto the sheet 4 in this manner, the next sheet 4 will be fed out from the pickup roller 10, in case where continuous printing is conducted. After the transfer of the image to the sheet 4 by the photosensitive drum 31 for the fourth color has been completed, the sheet 4 will be fed out from the conveying belt 18 to the fixing device 43, as described above, and thereafter, will be discharged onto the paper discharging tray 5, by way of the conveying rollers 46A, 46B and the paper discharging rollers 47A, 47B.

The image forming operation in this aspect includes operations on a sheet of paper 4, from a start of exposure of light by the scanner device 27 to the photosensitive drum 31 for the first color until completion of the transfer to the sheet 4 by the photosensitive drum 31 for the fourth color. During this image forming operation, the pickup roller 10 and the registration roller 13A will be intermittently driven, accompanying the motions for feeding out the next sheet 4 or so. In the pickup roller 10 and the registration roller 13A, variations of load torque may occur, following discontinuous motions such as the intermittent motions. In the paper feeding rollers 12A, 12B too, variations of load torque may occur, following discontinuous motions such as departure of a backward end of the sheet 4 from the nip position and intrusion of a forward end of the next sheet 4 into the nip position. However, because the driving motor 91 that drives these rollers 10, 12A, 13A is independently constructed from the first driving unit 1A that drives the conveying belt 18 and the photosensitive drum 31, the conveying belt 18 and the photosensitive drum 31 will be stably driven, without being affected by the variations of the load torque.

Effects of this Aspect

As described above, according to the aspect, the driving motor 91 for driving the cleaning device 20 drives also the pickup roller 10, the paper feeding roller 12A and the registration roller 13A. Therefore, as compared with the case where the cleaning device 20 is provided with an exclusive driving unit, downsizing and cost reduction of the image forming apparatus, and decrease of the electric power consumption can be achieved. In the paper feeding roller 12A, the load torque may considerably vary, at the time of intrusion and departure of the sheet 4, and in the pickup roller 10 and the registration roller 13A, the load torque may considerably vary, on occasion of the intermittent motions. Even though irregular rotation may occur in the driving motor 91 with such variations, there will be no functional trouble in the cleaning device 20, because the cleaning device 20 is such a part that relatively high driving accuracy may not be required. Moreover, because the driving motor 91 for driving the cleaning device 20, and the rollers 10, 12A, 13A is constructed independently from the first driving unit 1A for driving the conveying belt 18, the irregular rotation of the driving motor 91 will not be transmitted to the conveying belt 18, and therefore, deterioration of the image quality can be prevented.

Moreover, because the cleaning device 20 is provided with the cleaning roller 21, cleaning performance can be enhanced, as compared with the case where a brush or blade is employed.

Further, the image quality can be improved by using the polymerized toner as the developer. The polymerized toner that has adhered to the conveying belt 18 or so is unlikely to be removed, as compared with the pulverized toner. However, according to the aspect, it is possible to effectively remove the toner on the conveying belt 18, because the cleaning performance of the cleaning device 20 can be enhanced, by increasing the contact pressure of the cleaning roller 21 with respect to the conveying belt 18, or by other means.

Second Aspect

Figure 3:
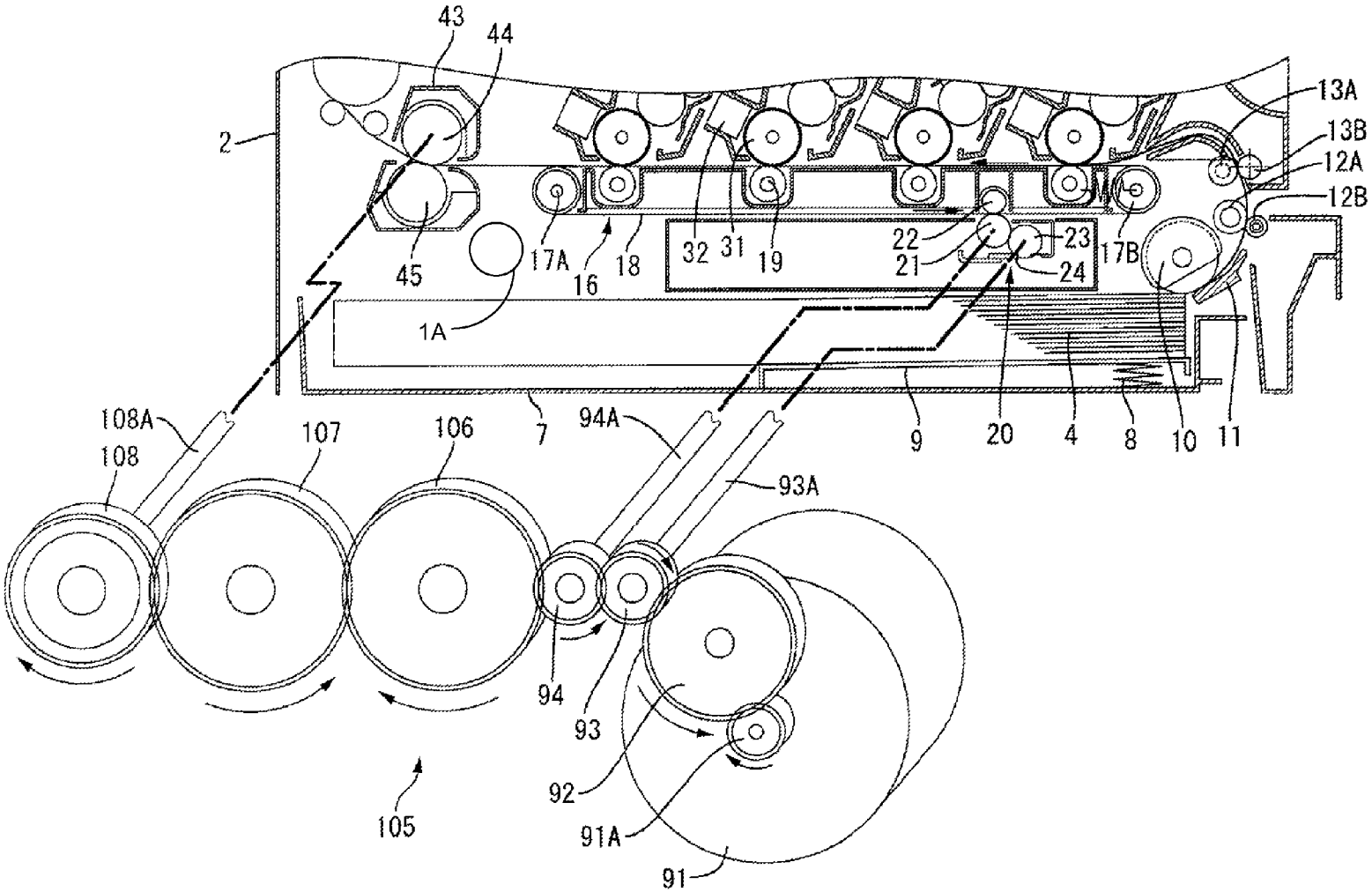
FIG. 3 is an explanatory view schematically showing a driving mechanism according to a second aspect.

FIG. 3 is an explanatory view schematically showing a driving mechanism 105 in a second aspect. The second aspect is different from the first aspect in the structure of the driving system, but a general structure of other components is substantially the same as in the first aspect. Therefore, the members having the same functions as in the first aspect will be denoted with the same reference numerals, and the description will partly be omitted.

A driving mechanism 105 includes a driving motor 91 as a power source, in the same manner as in the first aspect. The driving motor 91 has the driving gear 91A, which is meshed with the recovering gear 93 and the cleaning gear 94 via the relay gear 92. A pair of relay gears 106, 107 are successively meshed with the cleaning gear 94, and a fixing gear 108 which is connected to the heating roller 44 (the driven mechanism) of the fixing device 43 via a shaft body 108A is meshed with the relay gear 107. It is to be noted that the other driven components in the laser printer 1 (the belt supporting roller 17A, the photosensitive drum 31, the developing roller 40, the supply roller 39, the agitator 42, and so on) are driven by the first driving unit 1A, which is independent from the driving mechanism 105.

According to this aspect, in the fixing device 43, the load torque of the heating roller 44 may considerably vary particularly at the time of intrusion and departure of the sheet 4 to and from the nip position during the image forming operation. However, the variation will not affect the performance of the cleaning device 20. Moreover, because this variation of torque will not be transmitted to the first driving unit, it is possible to drive the conveying belt 18 with high accuracy.

Other Aspects

Figure 4:
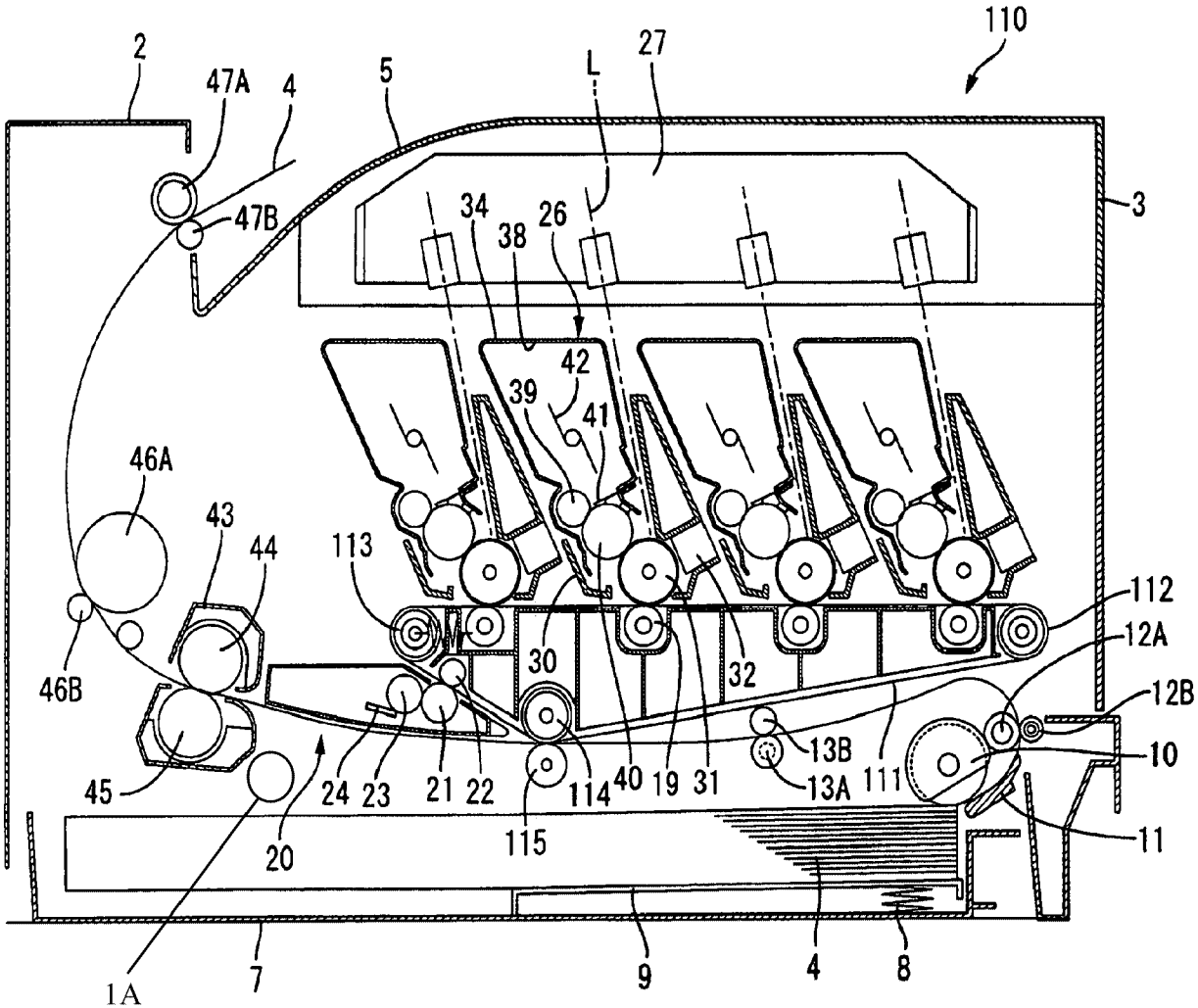
FIG. 4 is a sectional view schematically showing a structure of a laser printer according to another aspect.

In the above described aspects, the example in which the invention is applied to a color laser printer of a so-called tandem type for direct transfer has been described. However, it is possible to apply the invention to a color laser printer of a tandem type for intermediate transfer, as shown in FIG. 4. In the following description, the members having the same functions as in the first aspect will be denoted with the same reference numerals, and the description will be partly omitted.

A laser printer 110 in this aspect is provided with an intermediate transfer belt 111, in place of the conveying belt 18 in the first aspect. The intermediate transfer belt 111 is stretched around three belt supporting rollers 112, 113, 114, and will be cyclically rotated in a counterclockwise direction in the drawing, when the belt supporting roller 112 at a front side is driven to rotate. Below the belt supporting roller 114 at a lower side, a secondary transfer roller 115 is provided so as to be opposed to the roller 114, interposing the intermediate transfer belt 111. In this laser printer 110, the toner images formed on the four photosensitive drums 31 will be once transferred to the intermediate transfer belt 111 for the respective four colors, and thereafter, the toner images transferred to the intermediate transfer belt 111 will be transferred onto the sheet 4, while the sheet 4 passes the pressure contact position between the secondary transfer roller 115 and the intermediate transfer belt 111.

In the laser printer 110 of the tandem type for the intermediate transfer too, a second driving unit (not shown) for driving the cleaning device 20 drives also the pickup roller 10, the paper feeding roller 12A, the registration roller 13A, and the fixing device 43, in the same manner as in the above described aspects. At the same time, this second driving unit is independently constructed from a first driving unit, which is a driving source for the belt supporting roller 112 and the photosensitive drums 31. Accordingly, substantially the same effects as in the above described aspects can be obtained.

The invention is not limited to the aspects which have been described in the above description referring to the drawings, but, for example, the following aspects are also included in a technical scope of the invention. Further, it is possible to carry out various modifications besides the following aspects, within a scope not deviating from the gist of the invention.

(1) In the above-described aspects, the examples in which the invention has been applied to the laser printers of the tandem type for direct transfer and of the tandem type for intermediate transfer have been described. However, it is possible to apply the invention to an image forming apparatus of a so-called four cycle system in which developer images are sequentially formed on a surface of a single image carrier by means of developing devices for respective colors, and these developer images are sequentially superposed on a transferred member such as a sheet which is conveyed on a belt or an intermediate transfer belt and transferred, thereby to form a multi-colored image.

(2) In the above described aspects, the example in which a part of the driven components of the sheet conveying mechanism is driven by the second driving unit for driving the cleaning unit has been described. However, all the driven components of the sheet conveying mechanism may be driven by the second driving unit, or the mechanisms for conducting intermittent motions or discontinuous motions except the sheet conveying mechanism may be driven by the second driving unit.

What is claimed is:

1. An image forming apparatus comprising:

a photosensitive image carrier that forms an electrostatic latent image thereon;

a developing unit that supplies developer on the latent image on the image carrier to form the developer image;

an intermediate transfer belt for transferring, onto a sheet, the developer image that has been transferred from the image carrier to the intermediate transfer belt;

a cleaning unit that cleans the intermediate transfer belt;

a first driving unit that drives the image carrier, the developing unit and the intermediate transfer belt;

a second driving unit that drives the cleaning unit, the second driving unit being independent from the first driving unit; and a sheet conveying mechanism that conveys the sheet, wherein the second driving unit drives at least a part of the sheet conveying mechanism.

2. The image forming apparatus according to claim 1, wherein the sheet conveying mechanism includes a paper feeding roller that conveys the sheet to the belt, and the paper feeding roller is driven by the second driving unit.

3. The image forming apparatus according to claim 1, wherein the sheet conveying mechanism includes a fixing device having a heating roller that heats the sheet, and a pressurizing roller that presses the sheet toward the heating roller, and the heating roller is driven by the second driving unit.

4. The image forming apparatus according to claim 1, wherein the sheet conveying mechanism includes an intermittent motion mechanism that is intermittently driven by the second driving unit.

5. An image forming apparatus comprising:

a photosensitive image carrier that forms an electrostatic latent image thereon;

a developing unit that supplies developer on the latent image on the image carrier to form the developer image;

an intermediate transfer belt for transferring, onto a sheet, the developer image that has been transferred from the image carrier to the intermediate transfer belt;

a cleaning unit that cleans the intermediate transfer belt;

a first driving unit that drives the image carrier, the developing unit and the intermediate transfer belt;

a second driving unit that drives the cleaning unit, the second driving unit being independent from the first driving unit; and a driven mechanism that is driven by the second driving unit and conducts a discontinuous motion during image forming operation from a start of exposure of light to the image carrier until completion of transfer of a developer image onto the sheet.

6. The image forming apparatus according to claim 5, wherein the driven mechanism includes a paper feeding roller that conveys the sheet to the belt, and the paper feeding roller is driven by the second driving unit.

7. The image forming apparatus according to claim 5, wherein the driven mechanism includes a fixing device having a heating roller that heats the sheet, and a pressurizing roller that presses the sheet toward the heating roller, and the heating roller is driven by the second driving unit.

8. The image forming apparatus according to claim 5, wherein the driven mechanism includes an intermittent motion mechanism that is intermittently driven by the second driving unit.

9. The image forming apparatus according to claim 5, wherein the discontinuous operation is conducted when the sheet intrudes and departs to and from a nip position.

10. An image forming apparatus comprising:

a photosensitive image carrier that forms an electrostatic latent image thereon;

a developing unit that supplies developer on the latent image on the image carrier to form the developer image;

an intermediate transfer belt for transferring, onto a recording medium, the developer image that has been transferred from the image carrier to the intermediate transfer belt;

a residual developer collecting system that collects residual developer removed from the intermediate transfer belt;

a first driving unit that drives the image carrier, the developing unit and the intermediate transfer belt;

a second driving unit that drives a component of the residual developer collecting system, the second driving unit being independent from the first driving unit; and a recording medium conveying mechanism that conveys the recording medium, wherein the second driving unit drives at least a part of the recording medium conveying mechanism.

11. The image forming apparatus according to claim 10, wherein the recording medium conveying mechanism includes a paper feeding roller that conveys the recording medium to the intermediate transfer belt, and the paper feeding roller is driven by the second driving unit.

12. The image forming apparatus according to claim 10, wherein the recording medium conveying mechanism includes a fixing device having a heating roller that heats the recording medium, and a pressurizing roller that presses the recording medium toward the heating roller, and the heating roller is driven by the second driving unit.

13. The image forming apparatus according to claim 10, wherein the recording medium conveying mechanism includes an intermittent motion mechanism that is intermittently driven by the second driving unit.

14. The image forming apparatus according to claim 10, wherein the recording medium conveying mechanism includes a paper discharge roller, and the paper discharge roller is driven by the second driving unit.

15. The image forming apparatus according to claim 10, wherein the component of the residual developer collecting system is driven to rotate by the second driving unit.

16. The image forming apparatus according to claim 10, wherein the component of the residual developer collecting system is driven to rotate about a shaft by the second driving unit.

17. The image forming apparatus according to claim 10, wherein the residual developer collecting system includes: a container for storing residual developer removed from the intermediate transfer belt, and the component, wherein the component is a rotating member provided in the container.

18. An image forming apparatus comprising:

a photosensitive image carrier that forms an electrostatic latent image thereon;

a developing unit that supplies developer on the latent image on the image carrier to form the developer image;

an intermediate transfer belt for transferring, onto a sheet, the developer image that has been transferred from the image carrier to the intermediate transfer belt;

a cleaning unit that cleans the intermediate transfer belt;

a first driving unit that drives the image carrier, the developing unit and the intermediate transfer belt; and a second driving unit that drives the cleaning unit, the second driving unit being independent from the first driving unit.

* * * * *